US007563148B2

(12) United States Patent
Wei et al.

(10) Patent No.: US 7,563,148 B2
(45) Date of Patent: Jul. 21, 2009

(54) METHOD FOR MANUFACTURING A FIELD EMISSION DISPLAY

(75) Inventors: Yang Wei, Beijing (CN); Liang Liu, Beijing (CN); Shou-Shan Fan, Beijing (CN)

(73) Assignees: Tsinghua University, Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 662 days.

(21) Appl. No.: 11/148,665

(22) Filed: Jun. 9, 2005

(65) Prior Publication Data

US 2005/0287896 A1 Dec. 29, 2005

(30) Foreign Application Priority Data

Jun. 25, 2004 (CN) ..... 2004 1 0027905

(51) Int. Cl.
*H01J 9/00* (2006.01)

(52) U.S. Cl. ..... 445/24; 445/25; 430/311; 430/314; 430/319

(58) Field of Classification Search ..... 445/24, 445/25, 35, 36, 46, 47, 49; 430/311–321
See application file for complete search history.

(56) References Cited

U.S. PATENT DOCUMENTS

| | | | | |
|---|---|---|---|---|
| 4,164,059 | A * | 8/1979 | Van Esdonk | 445/47 |
| 4,898,557 | A * | 2/1990 | Engemann | 445/49 |
| 5,548,185 | A * | 8/1996 | Kumar et al. | 313/495 |
| 6,380,671 | B1 | 4/2002 | Lee | 313/495 |
| 6,617,798 | B2 | 9/2003 | Lee et al. | 315/169.3 |
| 2005/0233670 | A1 * | 10/2005 | Lee et al. | 445/46 |

* cited by examiner

*Primary Examiner*—Mariceli Santiago

(57) ABSTRACT

A method for manufacturing a field emission display, including: providing a cathode module having a plurality of cathode electrodes (32) and a plurality of electron emitters (33) arranged on the cathode electrodes; making a double-gated structure having an insulating plate (10) and a first gate electrode (14) and a second gate electrode (16) attached thereto, wherein a plurality of through holes (22) are defining through the insulating plate, the first gate electrode and the second gate electrode; providing an anode module having an anode electrode (35) and a phosphor layer (37) attached on the anode electrode; and assembling the cathode module, the double-gated structure and the anode module so as to form the field emission display.

14 Claims, 5 Drawing Sheets

METHOD FOR MANUFACTURING A FIELD EMISSION DISPLAY

BACKGROUND OF THE INVENTION

1. Field of the Invention

The present invention relates to a method for manufacturing a field emission display (FED), and more particularly to a method for manufacturing an FED having a double gate structure.

2. Related Art

Electronic displays are widely used for PC monitors, televisions (TVs) and other electrical products. These displays can be classified into cathode ray tubes (CRTs) and flat panel displays. Flat panel displays include liquid crystal displays (LCDs), plasma display panels (PDPs), and field emission displays (FEDs).

Field emission displays (FEDs) create a strong electrical field to extract electrons from emitters of a cathode electrode. The electrons collide with a phosphor material, whereby light emits from a desired pixel. A typical conventional field emission display comprises a plurality of emitters, with a microtip made of a metal such as molybdenum (Mo) being used as each emitter. With the development of nano-technologies, carbon nanotubes are widely used as emitters for FEDs. Such FEDs are sometimes known as carbon nanotube-based FEDs (CNT-FEDs). Compared to conventional technologies, e.g., cathode-ray tube (CRT) and liquid crystal display (LCD) technologies, CNT-FEDs have the advantages of a wide range of vision, high resolution, low energy consumption, smaller size, and good temperature stability.

Carbon nanotubes are very small tube-shaped structures essentially having a composition of a graphite sheet rolled into a tube. Carbon nanotubes produced by arc discharge between graphite rods were first discovered and reported in an article by Sumio Iijima entitled "Helical Microtubules of Graphitic Carbon" (Nature, Vol. 354, Nov. 7, 1991, pp. 56-58). Carbon nanotubes can have extremely high electrical conductivity, very small diameters (much less than 100 nanometers), large aspect ratios (i.e. length/diameter ratios) (greater than 1000), and a tip-surface area near the theoretical limit (the smaller the tip-surface area, the more concentrated the electric field, and the greater the field enhancement factor). Thus carbon nanotubes can transmit an extremely high electrical current, and have a very low turn-on electric field (approximately 2 volts/micron) for emitting electrons. For these reasons, carbon nanotubes have become of the most favored candidates for electrons emitters for electron emission devices, and now play an important role in field emission display applications. With the development of various different manufacturing technologies for carbon nanotubes, the research of carbon nanotube-based FEDs has yielded promising results.

Generally, FEDs can be roughly classified into diode type structures and triode type structures. Diode type structures have only two electrodes, a cathode electrode and an anode electrode. Diode type structures are unsuitable for applications requiring high resolution displays, because a typical diode type structure requires high voltages, produces relatively non-uniform electron emissions, and requires relatively costly driving circuits. Triode type structures were developed from diode type structures by adding a gate electrode for controlling electron emission. Triode type structures can emit electrons at relatively lower voltages, and can precisely control the emitted electrons to arrive at desired positions.

In order to realize better display quality, double gate-structured FEDs which have two gate electrodes have been developed. A conventional double gate-structured FED includes a substrate, a cathode layer formed on the substrate, a first insulating layer formed on the cathode layer, a first gate electrode formed on the first insulating layer, a second insulating layer formed on the first gate electrode, a second gate electrode formed on the second insulating layer, and an anode structure spaced from the cathode layer. The first insulating layer and the second insulating layer have a plurality of through holes for exposing the cathode layer. A plurality of emitters is provided on the exposed cathode layer, and electrons emitted from the emitters can travel through the through holes and arrive at a corresponding pixel. The second gate electrode of the conventional double gate-structured FED functions as a voltage control electrode or an electron focusing electrode, which facilitates a lower voltage threshold and focuses electrons toward to a corresponding pixel for high resolution display.

A conventional method for fabricating the above-described double gate-structured FED includes the steps of: forming a cathode layer on a substrate; forming a first insulating layer on the cathode layer; forming a first gate electrode with a first gate hole on the first insulating layer; forming a second insulating layer on the first insulating layer and the first gate electrode; forming a second gate electrode with a second gate hole on the second insulating layer; etching the second insulating layer through the second gate hole and the first insulating layer under the second insulating layer, and forming a through hole through which part of the cathode layer is exposed; forming a plurality of emitters on the exposed cathode layer; and assembling the obtained structure with an anode structure having a phosphor layer.

However, the above-described method may result in the following problems: first, the cathode layer is liable to be damaged during the etching step; second, the diameters of the through holes made by etching process are hard to control; and third, it is difficult to make the emitters in the through holes. Further, the structure of the insulating layers and the gate electrodes may be deformed or damaged during the fabricating of carbon nanotubes as the emitters, because of the high growth temperatures required.

Another conventional method for making the above-described double gate-structured FEDs includes the following steps: forming a cathode module which includes a substrate, a cathode layer being formed on the substrate and a plurality of emitters being formed on the cathode layer; forming a first gate module which includes a first insulation layer, a first gate layer, and a plurality of first through holes defined therein; forming a second gate module which includes a second insulation layer, a second gate layer and a plurality of second through holes defined therein; providing an anode module having a phosphor layer and an anode electrode attached on a transparent glass plate; assembling the first gate module and the second gate module with the cathode module; and assembling the anode module with the above-described obtained structure.

The above-described method is convenient for forming emitters, such as carbon nanotubes, on the cathode layer. Other modules are not deformed or damaged during the formation of the cathode module. However, the method is disadvantageous in that the first and the second gate modules need two alignments during assembling with the cathode module. The alignment of the two modules with very fine through holes is very difficult. Any mismatch or offset of the through holes of the two gate modules is liable to result in at least some of the electrons emitting from the emitters being blocked and not reaching the corresponding pixel. The quality of the display of the FED is diminished, or the display may even fail to function altogether.

Accordingly, what is needed is a method for manufacturing double gate-structured FEDs which overcomes the above disadvantages, eliminates mismatches, and promotes precision and high quality in mass production.

SUMMARY

An embodiment of the present invention provides a method for manufacturing a field emission display, the method comprising the steps of:

providing a cathode module having a plurality of cathode electrodes and a plurality of electron emitters arranged on the cathode electrodes;

making a double-gated structure by the sub-steps of:

providing an insulating plate;

forming two metallic thin films on two opposite surfaces of the insulating plate respectively;

conducting a photolithography process for partially etching one of the metallic thin films so as to obtain a plurality of mutually parallel strip-shaped gate electrodes; and defining a plurality of through holes which penetrate the gate electrodes, the other metallic thin film and the insulating plate;

providing an anode module having an anode electrode and a phosphor layer attached on the anode electrode; and assembling the cathode module, the double-gated structure and the anode module so as to form a field emission display.

Preferably, the cathode electrodes of the cathode module comprise strip-shaped conductive thin films.

The cathode electrodes are substantially parallel to each other.

The electron emitters comprise carbon nanotubes.

Even more preferably, the photolithography process comprises the sub-steps of:

coating a photo-resist layer on one of the metallic thin films to be etched;

placing a mask having a plurality of alternately arranged strip-shaped opaque portions and transparent portions on the photo-resist layer and performing an exposure process and a developing process on the photo-resist layer that covered by the transparent portions of the mask;

removing the mask and resolving parts of the photo-resist layer thereby portions of the metallic thin film being exposed; and etching the exposed portions of the metallic thin film.

The sub-step of defining a plurality of through holes comprises:

coating a first photo-resist layer and a second photo-resist layer on the other metallic thin film and the gate electrodes respectively;

placing a first mask having a plurality of circular transparent portions on the first photo-resist layer, and placing a second mask which is identical to the first mask on the second photo-resist layer in alignment with the first mask;

performing a double-surface exposure process, a develop process on the first and the second photo-resist layers so that portions of the other metallic thin film and the gate electrodes are exposed;

etching the exposed portions of the other metallic thin film and the gate electrodes for defining a plurality of first concave portions and a plurality of second concave portions on the other metallic thin film and the gate electrodes respectively; and penetrating portions of the insulating plate that between the first concave portions and corresponding second concave portions so that a plurality of through holes penetrating the gate electrodes, the other metallic thin film and the insulating plate are obtained.

Each of the photo-resist layers may be either a positive or a negative photo-resist layer.

Other systems, methods, features, and advantages will be or become apparent to one skill in the art upon examination of the following drawings and detailed description. It is intended that all such additional systems, methods, features, and advantages be included within this description, be within the scope of the present invention, and be protected by the accompanying claims.

DETAILED DESCRIPTION OF THE PREFERRED EMBODIMENTS

Reference will now be made to the drawings to describe a preferred embodiment of the present invention in detail.

According to a preferred embodiment of the present invention, a method for manufacturing a field emission display includes the steps of:

providing a cathode module with electron emitters;

making a double-gated structure having a first gate electrode and a second gate electrode formed on opposite sides of an insulating substrate, which may be accomplished by the sub-steps of:

providing an insulating plate;

depositing two metallic thin films on two opposite surfaces of the insulating plate respectively;

etching one of the metallic thin films by way of a photolithography process, to form a plurality of mutually parallel strip-shaped gate electrodes; and defining a plurality of through holes penetrating the gate electrode, the other metallic thin film, and the insulating plate therebetween;

providing an anode module having a phosphor layer and an anode electrode; and assembling the cathode module, the double-gated structure and the anode module into a field emission display.

It is noted that the three main components of the field emission display are the cathode module, the anode module, and the double-gated structure. These components are fabricated separately before assembly. The components may be fabricated in any sequence or simultaneously.

Figure 1:
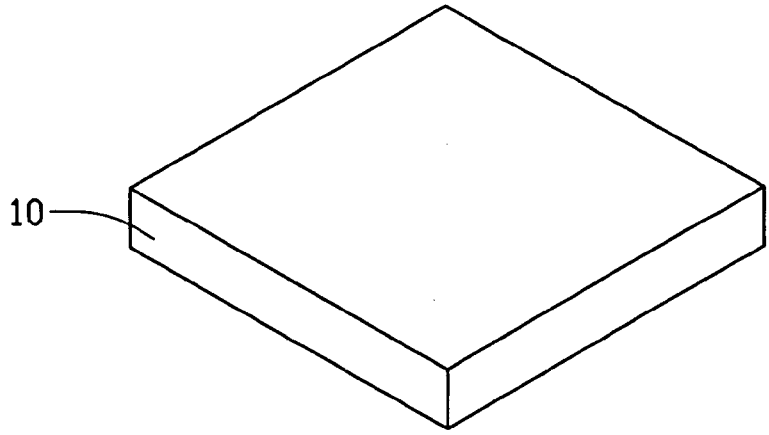
FIG. 1 is a schematic, isometric view of an insulating plate according to a preferred embodiment of the present invention.

Referring to FIGS. 1-11, various successive stages in a method for making a double-gate structure according to a preferred embodiment of the present invention are illustrated. Referring initially to FIG. 1, an insulating plate-like substrate 10 is provided. The insulating plate 10 is shaped as a thin plate or a flat sheet. The insulating plate 10 can be made of an insulating material such as glass, ceramic, or a like material that is frequently used in the electronics and semiconductor industries. Preferably, the insulating plate 10 has two opposite flat, polished surfaces (not labeled), which facilitates subsequent formation of metallic thin films thereon. A thickness of the insulating plate 10 can be determined according to a desired distance between two gate electrodes to be formed. Preferably, the thickness of the insulating plate 10 is in the range from 10 micrometers to 900 micrometers.

Figure 2:
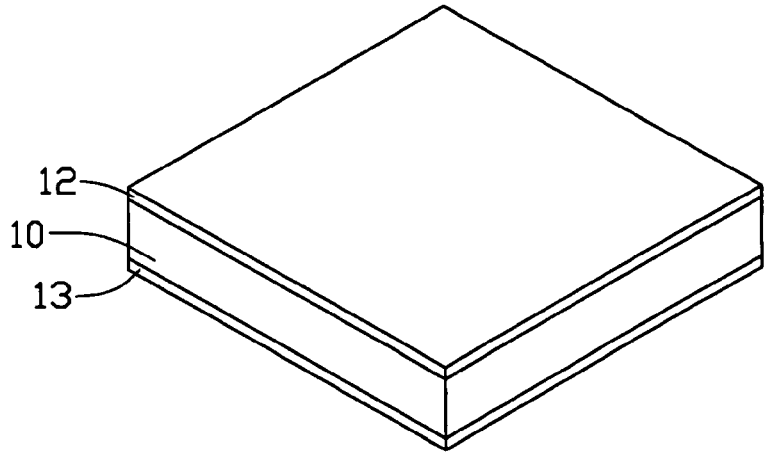
FIG. 2 is similar to FIG. 1, but showing a first metallic thin film and a second metallic thin film formed on two opposite surfaces of the insulating plate respectively.

Referring to FIG. 2, a first metallic thin film 13 and a second metallic thin film 12 are formed on the two opposite surfaces of the insulating plate 10. The first and second metallic thin films 13, 12 can be made of a metal that has good electrical conductivity. Considering its low cost and good electrical conductivity, copper is a preferred material for the metallic thin films 13 and 12 in the embodiment. The two metallic thin films 13, 12 can be formed by a thermal evaporation method, an electron-beam evaporation method, a chemical plating method, an electro-plating method, or a printing method. Preferably, the first and second metallic thin films 13, 12 are relatively thin, such as a figure on a micrometer scale.

Figure 3:
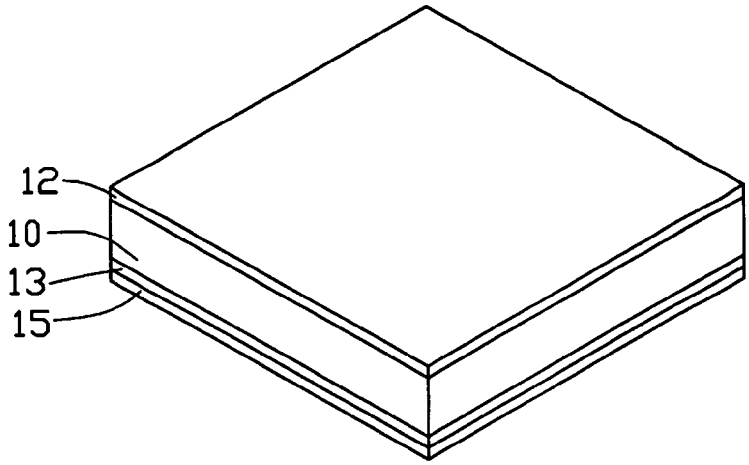
FIG. 3 is similar to FIG. 2, but showing a first photo-resist layer coated on the first metallic thin film.

Referring to FIGS. 3-6, a number of first gate electrodes 14 are formed by a photolithography process. As an example, this process can be accomplished by the sub-steps of:

First, referring to FIG. 3, coating a first photo-resist layer 15 on the first metallic thin film 13 by a spin coating method. The photo-resist layer 15 may comprise positive photo-resist or negative photo-resist. This embodiment uses a positive photo-resist as an example.

Figure 4:
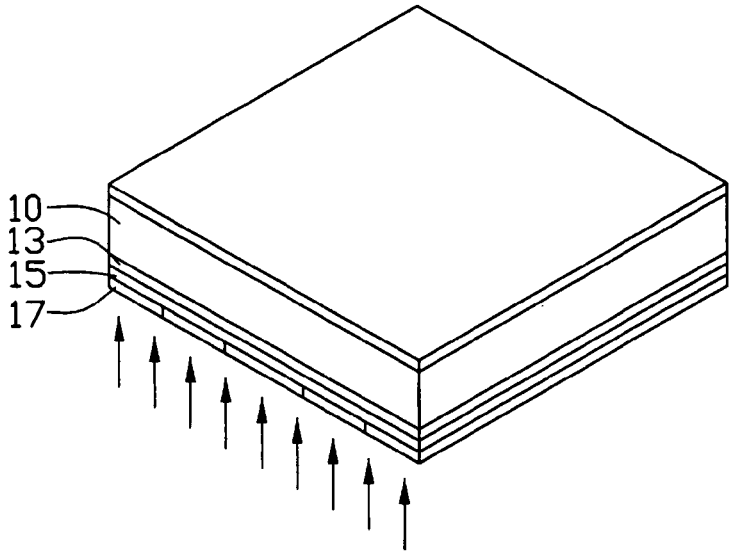
FIG. 4 is similar to FIG. 3, but showing a first mask placed on the first photo-resist layer and a first exposure process being performed.

Second, referring to FIG. 4, placing a first mask 17 on the first photo-resist layer 15 and performing a first exposure process. The first mask 17 has a number of strip-shaped opaque portions and strip-shaped transparent portions alternately disposed therein. Light irradiates the first mask 17 and transmits through the transparent portions. Therefore, portions of the first photo-resist layer 15 corresponding to the transparent portions of the first mask 17 are developed.

Figure 5:
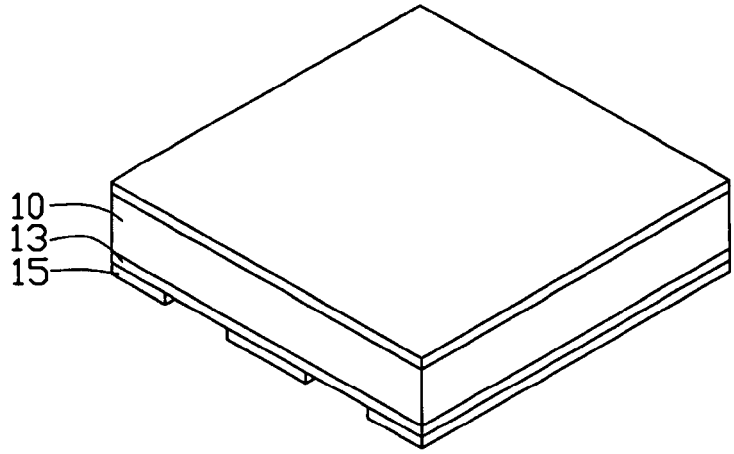
FIG. 5 is similar to FIG. 4, but showing portions of the first photo-resist layer removed.

Third, referring to FIG. 5, after the portions of the first photo-resist layer 15 have been developed, removing the first mask 17, and dissolving the developed portions of the photo-resist layer 15. Corresponding portions of the first metallic thin film 13 are thereby exposed.

Figure 6:
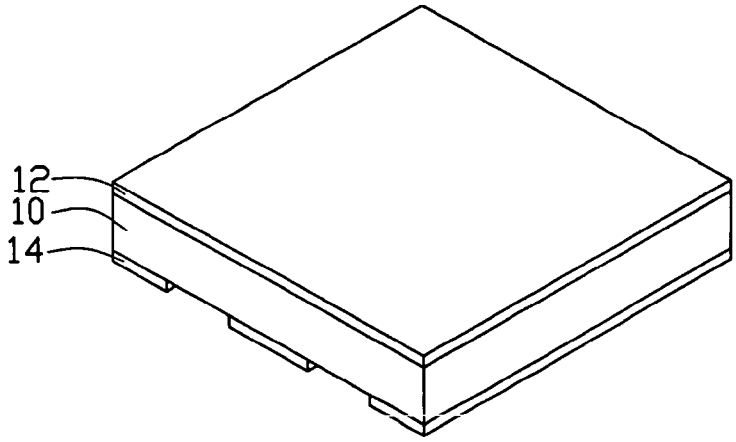
FIG. 6 is similar to FIG. 5, but showing a plurality of first gate electrodes formed after portions of the first metallic thin film have been removed.

Fourth, referring to FIG. 6, etching the exposed portions of the first metallic thin film 13, and removing the remaining photo-resist layer 15. A number of fist gate electrodes 14 are thereby obtained.

It is to be understood that if a negative photo-resist is used instead of the positive photo-resist, the portions of the first metallic thin film 13 that correspond to the opaque portions of the first mask 17 are etched, and remaining portions of the first metallic thin film 13 mature into gate electrodes.

Figure 7:
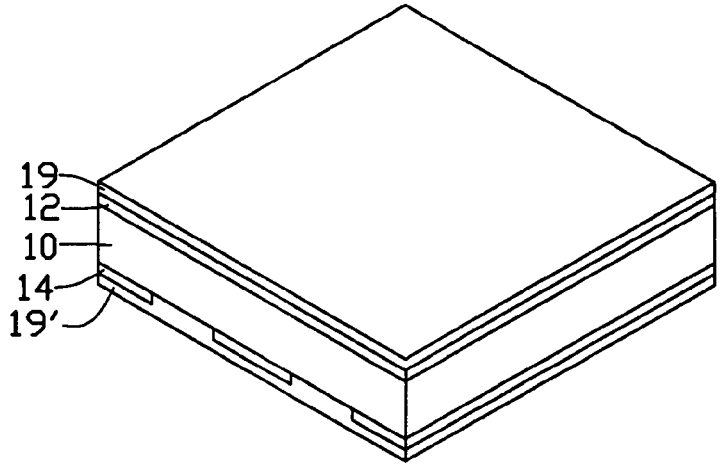
FIG. 7 is similar to FIG. 6, but showing a second photo-resist layer and a third photo-resist layer coated on the second metallic thin film and first gate electrodes respectively.
Figure 8:
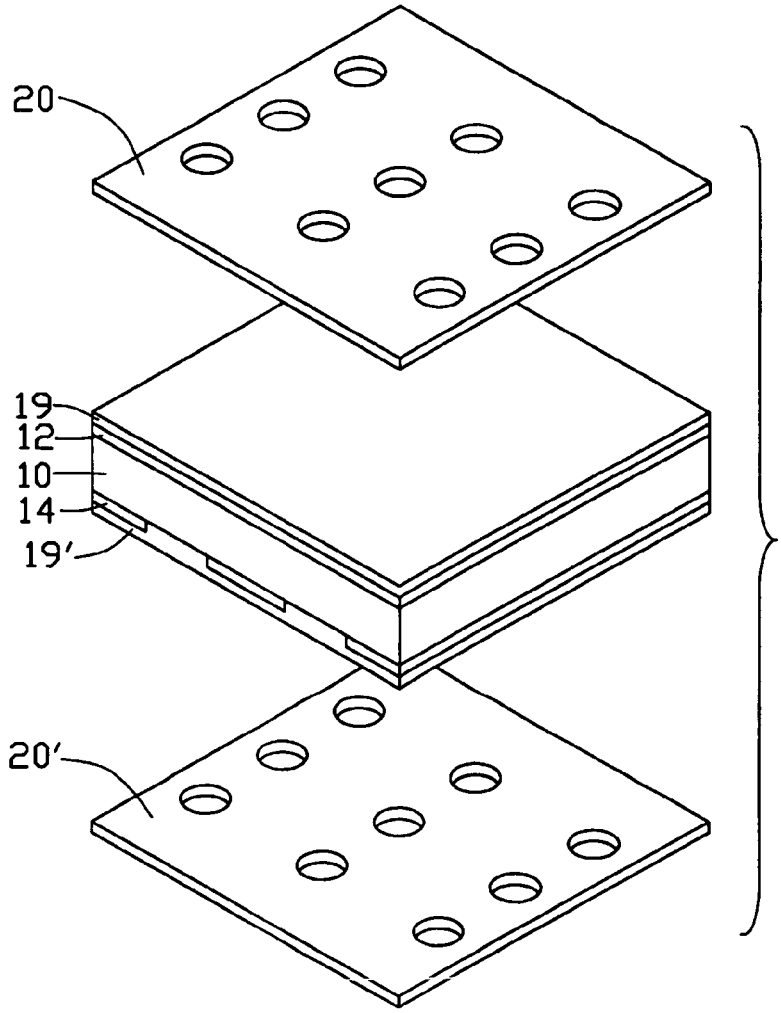
FIG. 8 is similar to FIG. 7, but showing a second mask and a third mask placed on the second and the third photo-resist layers respectively.

Referring to FIGS. 7-8, a number of gate holes (not shown) are formed on each of the gate electrodes 14 and the second metallic thin film 12 correspondingly. As an example, this process can be accomplished by the sub-steps of:

First, referring to FIG. 7, coating a second photo-resist layer 19 on a surface of the second metallic thin film 12. In addition, coating a third photo-resist layer 19' on surfaces of the first gate electrodes 14 and exposed portions of the insulating plate 10 that are not covered by the first gate electrodes 14. Similar to the first photo-resist layer 15 mentioned above, the photo-resist layers 19 and 19' may each be a positive photo-resist layer or a negative photo-resist layer. In the described embodiment, each of the photo-resist layers 19 and 19' is a positive photo-resist layer.

Second, placing a second mask 20 and a third mask 20' onto the second photo-resist layer 19 and the third photo-resist layer 19' respectively, performing a double-surface exposure process, and performing a developing process on the second and the third photo-resist layers 19, 19'. As a result, portions of the second metallic thin film 12 and the first gate electrodes 14 are exposed. Then an etching process is performed, for etching the exposed portions of the second metallic thin film 12 and the first gate electrodes 14 respectively. The second mask 20 and the third mask 20' are identical in shape and size. Each of the masks 20, 20' defines a number of through holes (not labeled) regularly distributed therein. For example, nine circular through holes are arranged in a matrix of three columns and three rows in each mask 20, 20', as shown in FIG. 8. As a result, portions of the first gate electrodes 14 corresponding to the through holes of the third mask 20' are removed, thereby defining a number of first gate holes (not labeled) in the first gate electrodes 14, as seen in FIG. 10. Similarly, also as a result, portions of the second metallic thin film 12 corresponding to the through holes of the second mask 20 are removed, thereby defining a number of second gate holes (not labeled) in the second metallic thin film 12, as seen in FIG. 10. The second metallic thin film 12 is thus transformed into a second gate electrode 16 (refer to FIG. 9), having the second gate holes defined therein. The first gate holes and the second gate holes completely penetrated the first gate electrodes 14 and the second metallic thin film 12 respectively, but do not comprise any part of the insulating plate 10.

In the double-surface exposure process, the second mask 20 and third mask 20' are aligned precisely. Accordingly, the first gate holes and the second gate holes formed by etching through the through holes of the masks 20, 20' are also aligned. That is, each first gate hole corresponds to a respective second gate hole.

Figure 9:
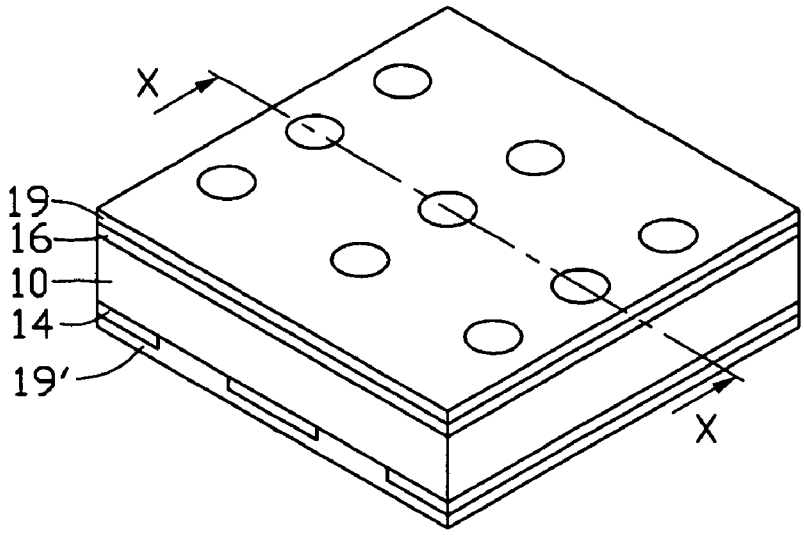
FIG. 9 is similar to FIG. 8, but showing a second gate electrode formed on the insulating plate after a second exposure and an etching process have been performed.
Figure 10:
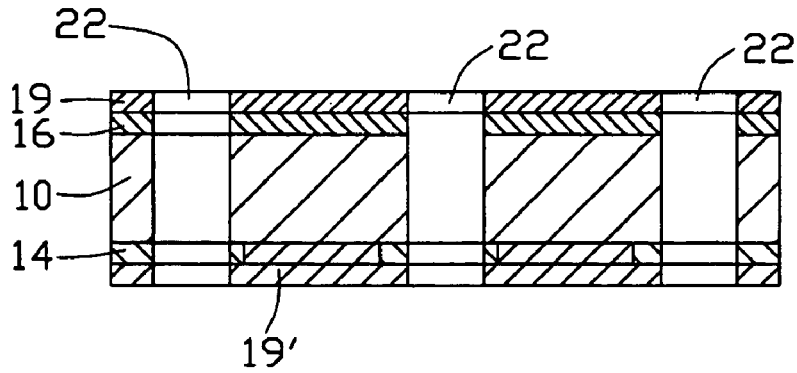
FIG. 10 is a cross-sectional view taken along line X-X of FIG. 9, showing a double-gated structure.
Figure 11:
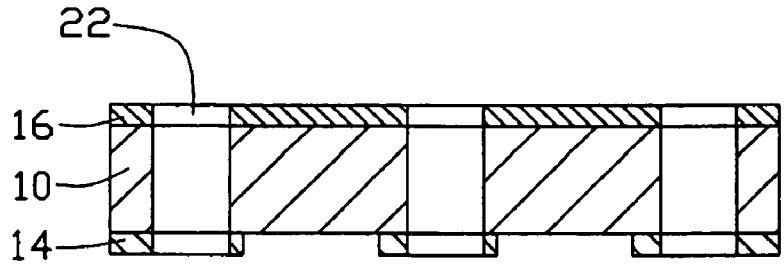
FIG. 11 is similar to FIG. 10, but showing the second photo-resist layer and the third photo-resist layer removed.

Referring to FIGS. 9-11, the second mask 20 and the third mask 20' are removed. Portions of the insulating plate 10 between each pair of a first gate hole and a corresponding second gate hole are removed, thereby forming a number of through holes 22 (as seen in FIG. 10). Hence, a double-gated structure (not labeled) having the first gate electrodes 14 and the second gate electrode 16 is obtained. As an example, this process can be accomplished by the sub-steps of:

First, penetrating the insulating plate 10 at positions between the first gate holes and the corresponding second gate holes by a sand blasting, etching, or laser irradiation method. Thus, a number of through holes 22 are defined. Each through hole 22 is in communication with a first gate hole and a corresponding second gate hole.

Second, removing the second photo-resist layer 19 and the third photo-resist layer 19'. Thus, the first gate electrodes 14 and the second gate electrode 16 are exposed.

As mentioned above, the double-gated structure is one of the three main components for a field emission display according to the preferred embodiment. The other two main components, the cathode module and the anode module, will be explained below.

Figure 12:
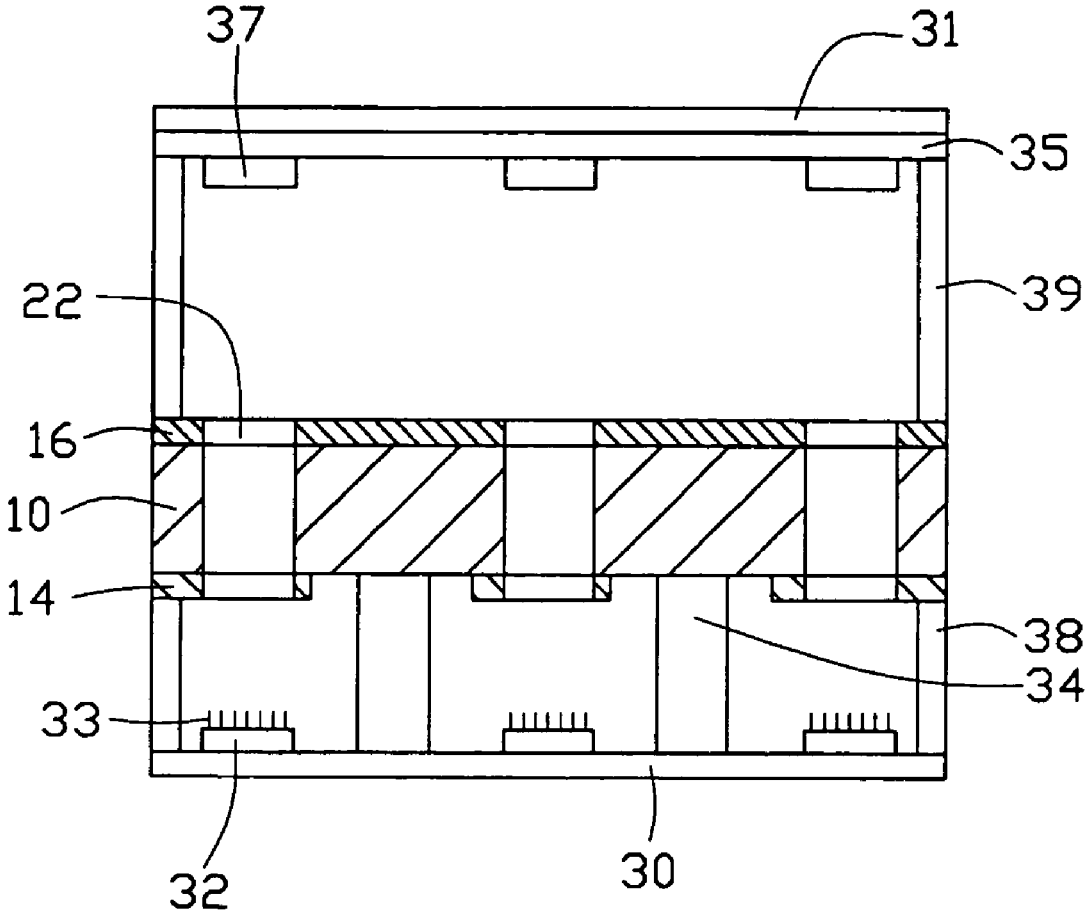
FIG. 12 is a schematic, simplified, side cross-sectional view of a field emission display made according to the preferred embodiment of the present invention.

Referring to FIG. 12, a cathode module and an anode module (not labeled) are provided, and the cathode module, the anode module and the double-gated structure are assembled together to form a field emission display.

The cathode module includes a bottom substrate 30, a number of cathode electrodes 32 arranged on the bottom substrate 30, and a number of emitters 33 disposed on each cathode electrode 32. The bottom substrate 30 can be made of an insulating material, such as glass, ceramic, quartz, etc. The cathode electrodes 32 may be made of a conductive material, such as metal, an ITO (indium tin oxide) thin film, etc. The emitters 33 may be made of silicon, graphite, diamond, carbon nanotubes, or a suitable metal or alloy. Preferably, the emitters 33 are made of carbon nanotubes. The cathode module may be made by a printing method, deposition, or another suitable method. For example, a typical printing method may include the following steps: providing a flat glass sheet used as a bottom substrate; printing a number of strip-shaped ITO thin films on a surface of the flat glass sheet by a screen printing process, said strip-shaped ITO thin films being substantially parallel to each other and separated from each other by short intervals; and printing a paste containing carbon nanotubes on a surface of each ITO thin film. It is preferred to further treat the carbon nanotubes to make at least first ends of the carbon nanotubes extend upwardly from the ITO thin films. In another embodiment, the cathode electrodes 32 may instead be a single cathode electrode deposited on an entire surface of the bottom substrate.

The anode module includes a top plate 31, an anode electrode 35 deposited on a surface of the top plate 31, and a phosphor layer 37 coated on a surface of the anode electrode 35. The top plate 31 may be a transparent, insulating glass sheet. The anode electrode 35 can be made of an ITO thin film. The phosphor layer 37 can emit visible light under bombardment of electrons.

The three main components, namely the cathode module, the double-gated structure and the anode module, are aligned and vacuum packaged. A field emission display is thus obtained. As shown in FIG. 12, the field emission display further includes insulating sidewalls 38 positioned between the cathode module and the double-gated structure, and insulating sidewalls 39 positioned between the double-gated structure and the anode module. Optionally, one or more spacer 34 may be positioned between the cathode module and the double-gated structure, for supporting the double-gated structure and maintaining its separation from the cathode electrodes 32.

As mentioned above, the cathode module, the double-gated structure and the anode module can be manufactured separately, whereupon these three main components are assembled into an integrated display device. Hence, the present method is advantageous in: (1) avoiding contamination of the emitters during formation of the gate electrode (as often occurs in a conventional method); (2) facilitating manufacturing of the emitters on the cathode electrodes; (3) reducing alignment steps during the assembling process, and eliminating mismatches that typically occur in conventional methods, thereby simplifying the manufacturing process; and (4) improving the quality of the final product.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

We claim:

1. A method for manufacturing a field emission display, comprising:

providing a cathode module comprising a plurality of cathode electrodes and a plurality of electron emitters arranged on the cathode electrodes;

manufacturing a double-gated structure, comprising:

providing an insulating plate;

depositing two metallic thin films on two opposite surfaces of the insulating plate respectively;

conducting a photolithography process, including partially etching one of the metallic thin films so as to obtain a plurality of mutually parallel strip-shaped gate electrodes; and defining a plurality of through holes which penetrate the gate electrodes, the other metallic thin film and the insulating plate;

providing an anode module comprising an anode electrode and a phosphor layer attached on the anode electrode; and assembling the cathode module, the double-gated structure and the anode module so as to form the field emission display.

2. The method as described in claim 1, wherein the cathode electrodes of the cathode module comprise strip-shaped conductive thin films.

3. The method as described in claim 2, wherein the cathode electrodes are substantially parallel to each other.

4. The method as described in claim 3, wherein the electron emitters comprise carbon nanotubes.

5. The method as described in claim 1, wherein the opposite surfaces of the insulating plate are flat, polished surfaces.

6. The method as described in claim 5, wherein a thickness of the insulating plate is in the range from 10 micrometers to 900 micrometers.

7. The method as described in claim 1, wherein the photolithography process comprises:

coating a photo-resist layer on one of the metallic thin films to be etched;

placing a mask having a plurality of alternately arranged strip-shaped opaque portions and transparent portions on the photo-resist layer, and performing an exposure process in order to irradiate parts of the photo-resist layer that covered by the transparent portions of the mask;

removing the mask and dissolving parts of the photo-resist layer, thereby exposing portions of the metallic thin film; and etching the exposed portions of the metallic thin film.

8. The method as described in claim 7, wherein the photo-resist layer is either a positive photo-resist layer or a negative photo-resist layer.

9. The method as described in claim 1, wherein the defining of a plurality of through holes comprises:

coating a first photo-resist layer and a second photo-resist layer on the other metallic thin film and on the gate electrodes respectively;

placing a first mask having a plurality of circular transparent portions on the first photo-resist layer, and placing a second mask identical to the first mask on the second photo-resist layer, the second mask being aligned with the first mask;

performing a double-surface exposure process and a developing process on the first and the second photo-resist layers, so that portions of the other metallic thin film and the gate electrodes are exposed;

etching the exposed portions of the other metallic thin film and the gate electrodes, in order to define a plurality of first gate holes and a plurality of second gate holes in the other metallic thin film and in the gate electrodes respectively; and removing portions of the insulating plate between the first gate holes and corresponding second gate holes, so that a plurality of through holes penetrating the gate electrodes, the other metallic thin film and the insulating plate are obtained.

10. The method as described in claim 9, wherein the first photo-resist layer and the second photo-resist layer each comprise either a negative photo-resist material or a positive photo-resist material.

11. The method as described in claim 9, wherein the removing of portions of the insulating plate is performed by sand blasting, etching, or laser irradiation.

12. The method as described in claim 1, wherein the anode module further comprises a transparent plate, with the anode electrode being attached to the transparent plate.

13. The method as described in claim 12, wherein, the anode electrode comprises an ITO (indium tin oxide) thin film.

14. The method as described in claim 1, wherein the cathode module, the double-gated structure, and the anode module are aligned and vacuum packaged.

* * * * *